US007938133B2

(12) United States Patent
Vondohlen et al.

(10) Patent No.: US 7,938,133 B2
(45) Date of Patent: May 10, 2011

(54) TENT WITH FOLD INDICATORS

(75) Inventors: Christopher D. Vondohlen, St. Louis Park, MN (US); Maeve Parker, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 108 days.

(21) Appl. No.: 12/328,948

(22) Filed: Dec. 5, 2008

(65) Prior Publication Data

US 2010/0139727 A1 Jun. 10, 2010

(51) Int. Cl.
*E04H 15/32* (2006.01)
*E04H 15/54* (2006.01)

(52) U.S. Cl. ..... 135/120.1; 135/115

(58) Field of Classification Search ..... 135/115, 135/119, 120.1; 493/243, 405, 397, 399; 53/116, 117, 429
See application file for complete search history.

(56) References Cited

U.S. PATENT DOCUMENTS 2,516,869 A 8/1950 Harris
3,878,638 A * 4/1975 Benjamin ..... 446/488
4,241,745 A 12/1980 Knox
4,380,133 A 4/1983 Arnstein
5,160,170 A 11/1992 Ferra
5,226,261 A * 7/1993 Wilbourn et al. ..... 52/2.21
5,234,231 A 8/1993 Hollander et al.
5,253,799 A 10/1993 Sebesta
5,282,749 A 2/1994 Ketch
6,094,759 A 8/2000 Thompson
6,158,777 A 12/2000 Twardosz
6,230,341 B1 5/2001 Dudley
7,222,635 B2 5/2007 Cantwell

* cited by examiner

*Primary Examiner* — David Dunn
*Assistant Examiner* — Danielle Jackson
(74) *Attorney, Agent, or Firm* — Griffiths & Seaton PLLC

(57) ABSTRACT

A tent assembly includes a storage container, a tent body, a first fold guide and a second fold guide. The tent body is configured to transition from an erect position to a collapsed position and is configured to be folded along a plurality of predetermined fold lines to fit within the storage container when the tent body is in the collapsed position. The first fold guide is coupled to the tent body and is spaced a first distance from and positioned on a first side of one of the plurality of predetermined fold lines. The second fold guide is coupled to the tent body and spaced the first distance from and positioned on a second side of the one of the plurality of predetermined fold lines, wherein the second side is opposite the first side. Other tents, tent bodies and associated methods are also described.

21 Claims, 6 Drawing Sheets

TENT WITH FOLD INDICATORS

BACKGROUND OF THE INVENTION

Tents are portable structures made of lightweight, substantially water resistant fabrics. Typically, a tent is generally a collapsible shelter of nylon, polyester or other suitable material stretched over and supported by framework, such as one or more poles. Tents are used for camping outdoors, hunting or as temporary structures for other events. Tents come in a variety of shapes, including dome and cabin style tents.

In general, tents are configured to be disassembled and manipulated into a relatively small bundle, which decreases the amount of space needed to store or transport the tent during periods of non-use. A bag or other storage container may be sold with or purchased to correspond with a particular tent. The storage container is sized to receive the tent once it is collapsed and rolled or folded for storage. Generally, the storage container is just slightly larger than the tent when it is collapsed and rolled or folded into the relatively small bundle. At times, it can be challenging to collapse a tent and manipulate it to form a bundle that can fit within the given storage container. Such challenges are amplified when the tent is being disassembled during inclement weather or other extenuating circumstances.

SUMMARY OF THE INVENTION

One aspect of the present invention relates to a tent assembly including a storage container, a tent body, a first fold guide and a second fold guide. The tent body is configured to transition from an erect position to a collapsed position and is configured to be folded along a plurality of predetermined fold lines to fit within the storage container when the tent body is in the collapsed position. The first fold guide is coupled to the tent body and is spaced a first distance from and positioned on a first side of one of the plurality of predetermined fold lines. The second fold guide is coupled to the tent body and spaced the first distance from and positioned on a second side of the one of the plurality of predetermined fold lines, wherein the second side is opposite the first side. Other associated tents and methods are also described.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A tent, according to embodiments of the present invention, is provided with fold guides secured to the tent body in a manner configured to intuitively provide a user with instructions for folding the tent for storage and/or transportation following periods of use. The fold guides not only instruct a user regarding the order in which particular folds should be made, but also provide an indication of where the fold lines should be located. Since the user knows where the fold lines should be located and the order in which folds should be made, the user can more easily fold the tent to a size and shape that easily fits within a corresponding storage container. More specifically, prior to the present invention, it was often difficult to fold a tent body to desired dimensions to easily fit within the corresponding storage container. This innovation allows the user to repeatedly and easily fold the tent to desired dimensions based on an associated storage container. As such, user frustrations due to tent folding can be decreased if not eliminated.

Figure 1:
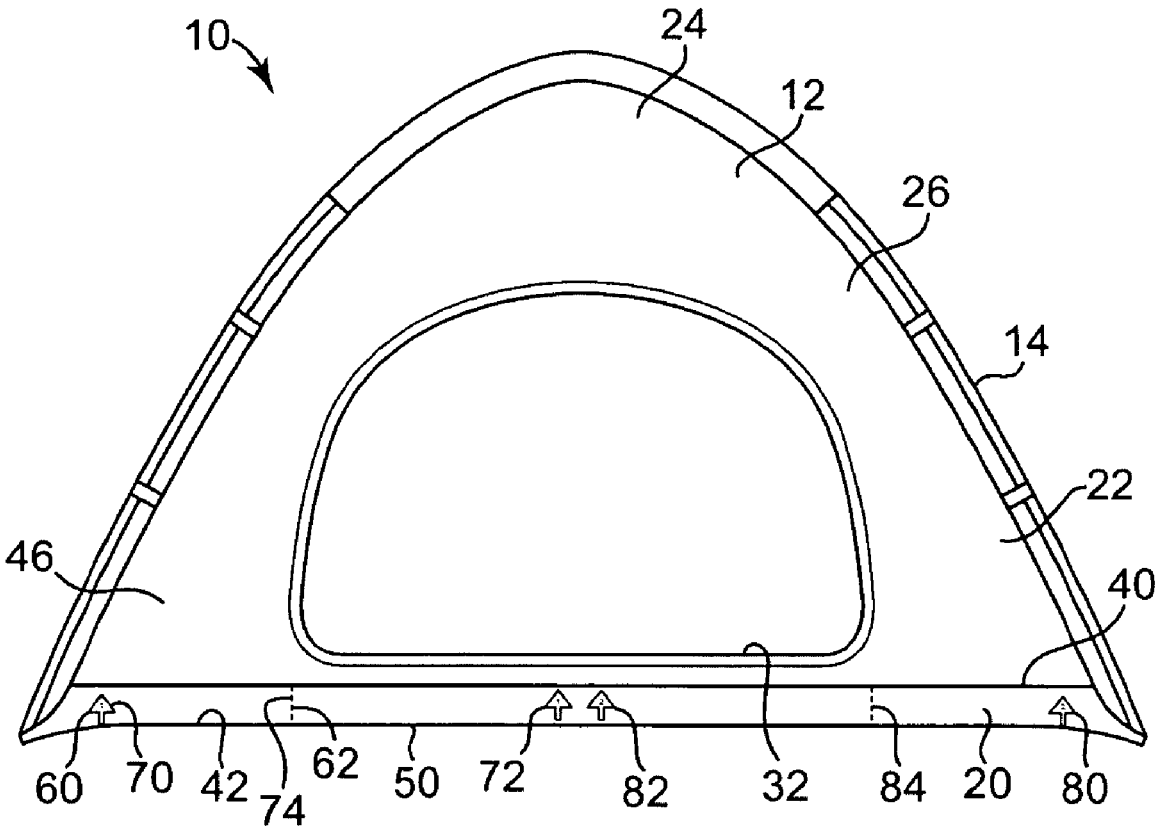
FIG. 1 is a front view illustration of a tent in an erect position, according to one embodiment of the present invention.

Turning to the figures, FIG. 1 illustrates one embodiment of a tent 10 including a tent body 12 (or tent shell) and framework 14. While tent 10 is illustrated as a dome tent, it should be understood that the invention disclosed herein can be incorporated into other types of tents such a cabin tents, party tents, etc. Tent body 12 may be formed of any suitable material(s) configured to be supported by framework 14. Framework 14 generally includes one or more poles configured to be coupled with the tent and/or one another to support tent body 12 above the ground to form a shelter.

In one embodiment, tent body 12 (e.g., tent shell) includes a floor 20 and a fabric enclosure 22. In one example, floor 20 is formed of a stiffer and more robust fabric than fabric enclosure 22. During use, floor 20 is configured to rest directly on a ground surface and to withstand foot traffic and support of items placed within tent body 12. Floor 20 also substantially prevents water, even water pooling on an outside surface of floor 20, from entering tent body 12. In one example, floor 20 is formed of a suitable material such as a material including polyethylene plastic, nylon or polyester, and may be treated with a suitable coating to increase the robustness and/or water resistance of floor 20 such as a polyurethane coating.

Fabric enclosure 22 is formed of a suitable readily collapsible, breathable and relatively lightweight material such as nylon, polyester taffeta, etc. and may include one or more coatings to increase durability and water resistance such as a polyurethane coating, a fluorocarbon polymer coating, etc. In one embodiment, fabric enclosure 22 defines walls 24, which include front wall 26, rear wall 28 and side walls 30, door 32 and windows (not shown), if any. While floor 20 generally defines the overall floor plan of tent body 12, fabric enclosure 22 generally defines the height and confines of tent 10. In one embodiment, floor 20 is coupled to fabric enclosure 22 with stitching, ultrasonic welding and/or other suitable method to define seam 40 therebetween.

In one example, floor 20 not only covers the ground below, but extends upward from ground level, which is generally indicated in FIG. 1 at 42, a short distance, for example, three to ten inches. As such, in one example, seam 40 is elevated above ground level 42 by three to ten inches. Forming seam 40 elevated from ground level 42 decreases the chances that seam 40 will be positioned in or otherwise adjacent to standing water, which, in turn, decreases the likelihood that water will seep into tent 10 through seam 40. In this configuration, bottom portion 44 of tent 10 is formed by floor 20 and refers to a portion of tent 10 extending substantially parallel to and just over ground level 42. Top portion 46 of tent 10 is collectively formed by floor 20 and fabric enclosure 22 and extends generally upwardly from and above ground level 42 during use of tent 10.

Following use of tent 10, framework 14 is removed from tent 10, and fabric enclosure 22 is collapsed. For example, side walls 30 are collapsed and folded inwardly toward one another. Then, rear wall 28 is folded toward front wall 26 and front wall 26 is folded down over at least a portion of rear wall 28 or vice versa. As such, top portion 46 is folded relatively flat over bottom portion 44. When collapsed, similarly to when erect, a front edge 50, rear edge 52, first side edge 54 and second side edge 56 are defined along the transition line between top portion 46 and bottom portion 44. Front edge 50 and rear edge 52 are positioned generally opposite one another. First and second side edges 54 and 56 are positioned generally opposite one another and each extends between front edge 50 and rear edge 52.

To facilitate a user in expeditiously transitioning tent 10 from a substantially flat, collapsed position into a bundle 100 (FIG. 8) configured to fit within a corresponding storage container 102 (FIG. 8), tent 10 includes fold guides such as fold indicators 60 and/or fold line markings 62 (or fold contour markings). More specifically, fold indicators 60 are included to intuitively instruct (i.e., instruct in a manner readily learned or understood) the user on a relatively efficient manner of folding tent 10 into the desired size bundle 100 generally without substantial reference to an instruction manual or other folding guide. Fold indicators 60 may be coupled with tent 10 in any suitable manner. Fold guides are one example of means for indicating a location of desired fold lines or contours to transition tent body 12 for storage in storage container 102.

Figure 3:
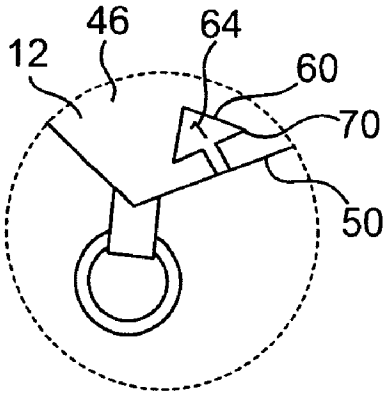
FIG. 3 is a detailed view of a portion of the tent body illustrated in FIG. 2, according to one embodiment of the present invention.
Figure 5:
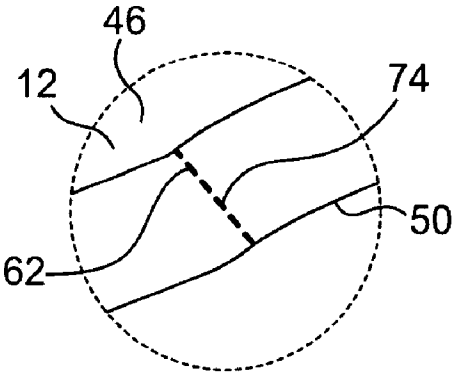
FIG. 5 is a detailed view of a portion of the tent body illustrated in FIG. 2, accordingly to one embodiment of the present invention.
Figure 4:
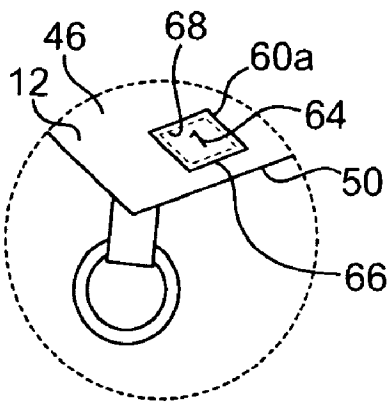
FIG. 4 is a detailed view of the portion of the tent body illustrated in FIG. 2, according to one embodiment of the present invention.

Referring to the detail view of FIG. 3, in one example, each fold indicator 60 is printed to tent 10 (e.g., floor 20 and/or fabric enclosure 22) and includes labeling 64, which contributes to the self-instructive or intuitive nature of fold indicators 60 as will be further described below. Referring to the alternative detail view of FIG. 4, in one example, each fold indicator 60 is provided in the form of a patch 66 that is sewn, adhered, ultrasonically welded and/or otherwise coupled to one or both of floor 20 and fabric enclosure 22, for instance, as generally indicated by coupling line 68. In one example, fold indicators 60 are provided in pairs configured to be matched by placing fold indicators 60 adjacent one another (i.e., directly on top of one another) when tent body 12 is folded in a desired fashion. For instance, each fold indicator 60 in a pair of indicators may be provided on opposite sides of a predetermined fold line such that fold indicators 60 are matched up with one another when tent body 12 is folded along the corresponding predetermined fold line as will be further described below.

Figure 2:
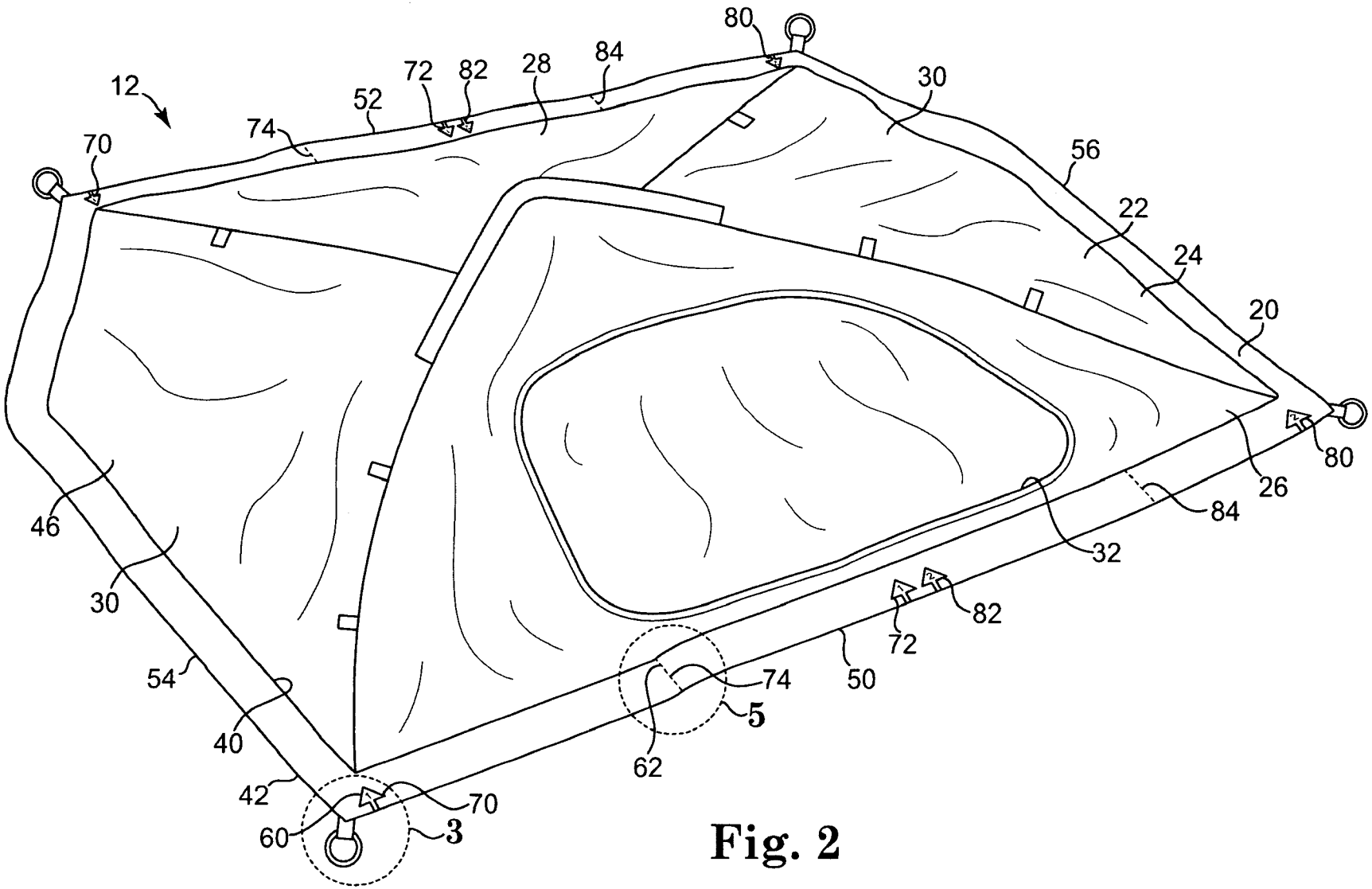
FIG. 2 is a top perspective view illustration of a tent body in a collapsed position, according to one embodiment of the present invention.

In one embodiment, fold line or contour markings 62 are provided in addition to or as an alternative to fold indicators 64. Each fold line marking 62 generally is positioned on tent body 12 to indicate where a predetermined fold line or contour is located. For example, as illustrated in FIG. 2 and in further detail in FIG. 4, a fold line marking 62 consists of a dashed or solid linear line printed, sewn, or otherwise coupled to tent body 12 (e.g., floor 20 and/or fabric enclosure 22) along a portion of the actual corresponding fold line. In one embodiment, a different fold line marking 62 is provided for each of a plurality of predetermined fold lines. In one embodiment, more than one fold line marking 62 is provided along or to otherwise indicate a single predetermined fold line. For example, one fold line marking 62 may be provided at each end of a single predetermined fold line.

FIG. 2 depicts tent body of FIG. 1 in a collapsed state without framework 14, stakes and/or any other non-integral support structure attached thereto. FIGS. 2 and 6-8 illustrate collapsed tent 10 being folded in a predetermined manner as intuitively directed by fold indicators 60 and/or fold line markings 62. As illustrated, tent 10 is folded into an appropriately sized bundle 100 (FIG. 8) when tent body 12 is folded along first fold line 76 (FIG. 6), second fold line 86 (FIG. 7) and third fold line 96 (FIG. 8), which are predetermined during manufacture of tent body 12, in sequential order.

Figure 6:
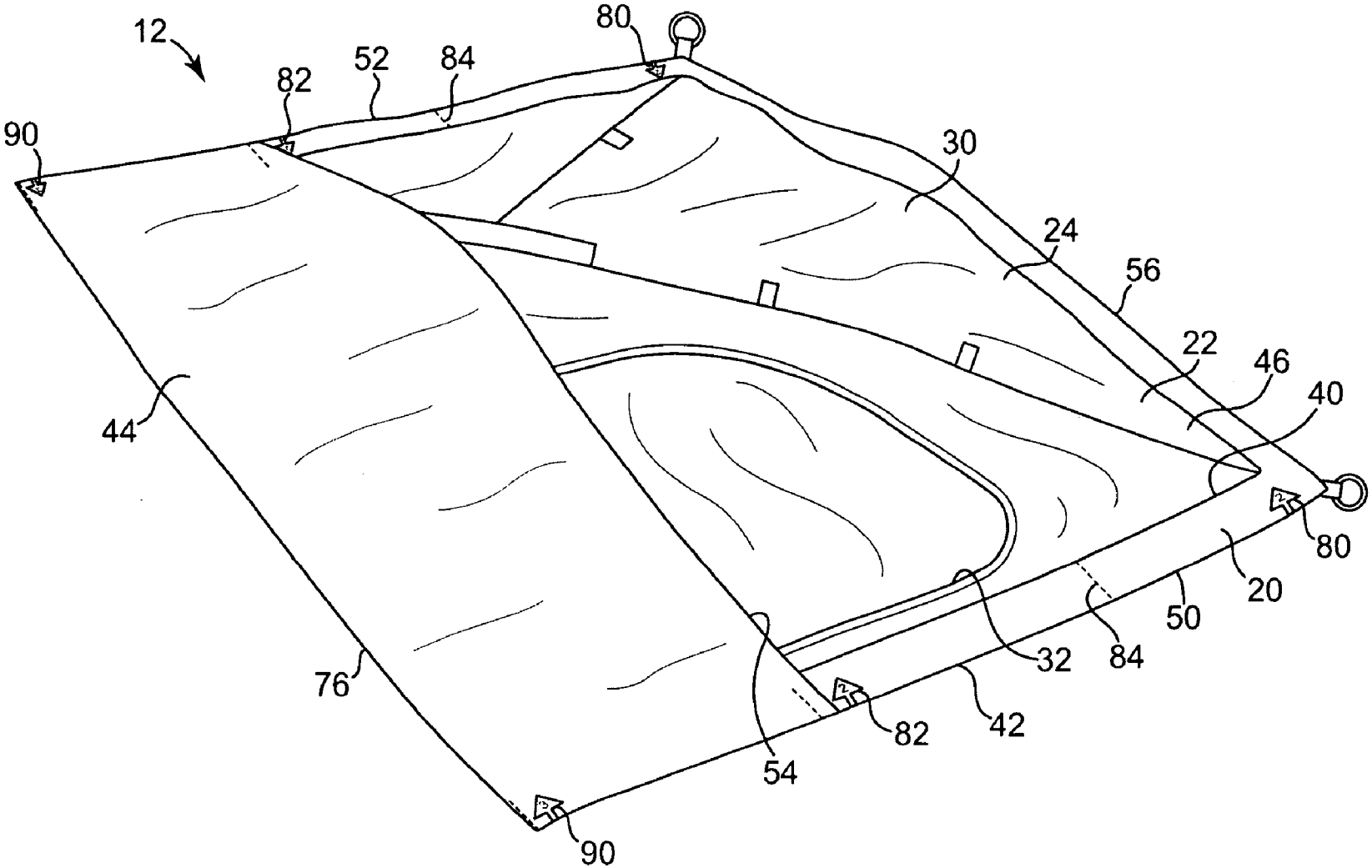
FIG. 6 is a top perspective view of the tent body of FIG. 2 folded along a first fold line, accordingly to one embodiment of the present invention.

More specifically, referring to FIGS. 2 and 6, tent body 12 includes first fold indicator 70 and second fold indicator 72, which collectively define a first fold indicator pair. First fold indicator 70 is positioned on a first side of first, predetermined fold line 76 (FIG. 6) and is a first distance away from first fold line 76. Notably, as illustrated in FIG. 2, first fold line 76 (FIG. 6) will extend linearly between the two fold line markings 74, as will become further apparent below. Second fold indicator 72 is positioned on a second side of first fold line 76, which is opposite first side of first fold line 76, and the first distance away from first fold line 76. As such, when a user folds tent body 12 in a manner matching first fold indicator 70 with second fold indicator 72 (e.g., in a manner placing first fold indicator 70 directly on top of second fold indicator 72 or vice versa), tent body 12 is folded along first predetermined fold line 76.

To facilitate a user in deciding to fold or otherwise bend or manipulate tent body 12 to match first pair of fold indicators 70 and 72, fold indicators 70 and 72 are configured to visually correspond with one another. For example, as illustrated, first and second fold indicators 70 and 72 may be substantially identical and include similar labeling 64 (FIG. 3). In one embodiment, labeling 64 additionally or alternatively indicates the order in which tent body 12 should be folded along fold lines 76, 86 and 96. For instance, first and second fold indicators 70 and 72 may each include the number "1," the letter "A" or something similar to indicate that they are each part of the first fold indicator pair and correspond with the first of the so-defined fold lines. In one embodiment, the order of folding and correspondence between fold indicator pairs is indicated with differences between first and second fold indicators 70 and 72.

For example, first fold indicator 70 may include the number "1," the letter "A" or something similar while second fold indicator 72 includes a number or letter that generally follows the number or letter of first fold indicator 70 in a well-known sequence. For instance, second fold indicator 72 may include the number "2," the letter "B" or similar character such that the user is intuitively instructed to fold "1" onto "2," "A" onto "B" or similar. Other visual manners of linking first fold indicator 70 to second fold indicator 72 (e.g., similar or corresponding colors, images, and/or patterns) are also contemplated.

In one embodiment, first fold line marking 74 is additionally or alternatively coupled to tent body 12. First fold line marking 74 is positioned along first fold line 76, for example, as a dashed line segment that is partially coextensive with first fold line 76. In one example, first fold indicator 70, second fold indicator 72 and/or first fold line marking 74 are all positioned near one edge (e.g., front edge 50 of tent body 12) wherein first fold line 76 extends between the one edge and an opposite edge (e.g., front edge 50 and rear edge 52 of tent body 12).

To further facilitate the substantially intuitive and self-instructive folding of tent body 12, in one embodiment, first fold indicator 70, second fold indicator 72 and/or first fold line marking 74 are substantially duplicated near the opposite edge (e.g., rear edge 52). In this manner, first fold line 76 is more completely defined by fold indicators 60 and fold line marking 62. Furthermore, by including fold indicators 60 and/or fold line markings 62 on two opposing edges of tent body 12, two users can quickly work together to fold tent with each user having her own set of indicators 60 and markings 62 to guide folding of tent body 12. In the embodiment illustrated, the intuitive pairing of first fold indicator 70 and second fold indicator 72 instructs the user to fold first side edge 54 toward and/or nearly to a center line (not illustrated) of tent body 12 as shown with reference, for example, to FIGS. 2 and 6, collectively.

Figure 7:
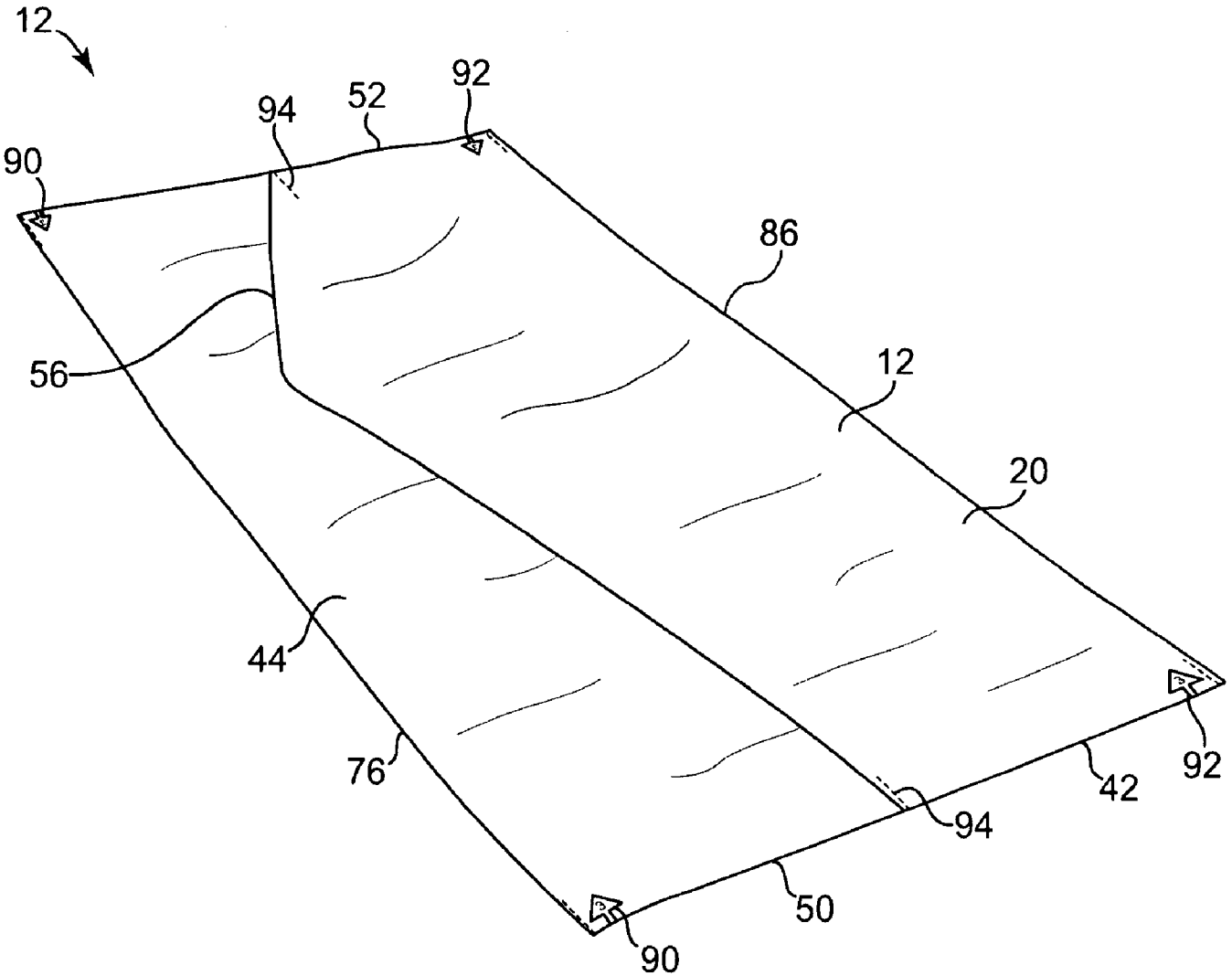
FIG. 7 is a top perspective view of the tent body of FIG. 6 folded along a second fold line, accordingly to one embodiment of the present invention.

Referring to FIGS. 2, 6 and 7, in one example, tent body 12 includes third fold indicator 80 and fourth fold indicator 82, which collectively define a second fold indicator pair. Third fold indicator 80 is positioned on a first side of second predetermined fold line 86 (FIG. 7) and is a second distance away from second fold line 86. Fourth fold indicator 82 is positioned on a second side of second fold line 86, which is opposite first side of second fold line 86, and is the second distance away from second fold line 86. As such, when the user folds tent body 12 in a manner matching third fold indicator 80 with fourth fold indicator 82 (e.g., in a manner placing third fold indicator 80 directly on top of fourth fold indicator 82 or vice versa), tent body 12 is folded along second predetermined fold line 86.

To prompt a user to fold tent body 12 in a manner matching the second pair of fold indicators 80 and 82, third and fourth fold indicators 80 and 82 are configured to visually correspond with one another (e.g., to be substantially identical to one another and/or to include similar labeling). In one embodiment, labeling of third and forth fold indicators 80 and 82 additionally or alternatively indicates the order in which tent body 12 should be folded along fold lines 76, 86 and 96. For instance, if first and second fold indicators 70 and 72 each include the number "1," the letter "A" or something similar to indicate that they are each part of the first fold indicator pair, third and fourth fold indicators 80 and 82 each include the number "2," the letter "B" or something similar (e.g., other character generally known to be in sequence after a character on first and second fold indicators 70 and 72) indicating that they are part of the second fold indicator pair and should be matched after the first fold indicator pair(s) are matched.

In one embodiment, the order of folding and correspondence is indicated with differences between third and fourth fold indicators 80 and 82. For example, where first fold indicator 70 includes the number "1," the letter "A" or something similar and second fold indicator 72 includes a number or letter the follows the number or letter of first fold indicator 70 in a well-known sequence (e.g., the number "2," the letter "B" or similar character), third fold indicator 80 includes the next character in the well-known sequence, for example, "3, "C" or other suitable labeling. Continuing this pattern, fourth fold indictor 82 includes "4," "D" or other suitable labeling indicating yet the next character in the well-known sequence. In this manner, the user is intuitively instructed to fold tent body 12 in the predetermined order, that is to first fold tent body 12 along first fold line 76 (e.g., by matching first fold indicator 70 to second fold indicator 72) and to subsequently fold tent body 12 along second fold line 86 (e.g., by matching third fold indicator 80 to fourth fold indicator 82). Other visual manners of linking third fold indicator 80 to fourth fold indicator 82 (e.g., similar or corresponding colors, images, and/or patterns) are also contemplated.

In one embodiment, second fold line marking 84 is additionally or alternatively coupled to tent body 12. Second fold line marking 84 is positioned along second fold line 86 in a similar manner as first fold line marking 74 is positioned along first fold line 76 as described above. In one embodiment, second fold line marking 84 is substantially duplicated on an opposite edge of tent body 12(e.g., is included on both front edge 50 and rear edge 52).

Tent body 12 may additionally include fifth and sixth fold line indicators 90 and 92 and third fold line marking 94 associated with third fold line 96 in a similar manner as first and second fold indicators 70 and 72 and first fold line marking 74 are associated with first fold line 76. As such, fifth and sixth fold line indicators 90 and 92 collectively define a third fold line indicator pair. In one example, fifth and sixth fold line indicators 90 and 92 are coupled to and viewable from bottom portion 44 of tent body 12. In such an embodiment, fifth and sixth fold line indicators 90 and 92 are not generally visible when tent body 12 remains on the ground following use until after tent body 12 is folded along one or both of first and second fold lines 76 and 86. Fifth and sixth fold line indicators 90 and 92 like the other fold line indicators include labeling or other indication to substantially intuitively instruct the user regarding when tent body 12 should be folded along third fold line 96 (FIG. 8) (e.g., after folding tent body 12 along first fold line 76 and second fold line 86). In view of the above, fold guides with labeling 64 and/or other characteristics described herein are examples of means for indicating an order in which tent body 12 should be folded along a plurality of predetermined or otherwise desired fold lines.

In one embodiment, tent body 12 is sold with or otherwise corresponds with storage container 102 sized and shaped to relatively snugly receive tent body 12 when tent body 12 has been folded and manipulated to form bundle 100 in a desired shape and size. For example, once tent body 12 is folded, bundle 100 has a final width slightly smaller than at least one inside dimension of storage container 102. In one example, storage container 102 is a bag having an opening 104 at a first end thereof. In one embodiment, a cord 106 extends through the bag around opening 104. Pulling on cord 106 relative to the bag cinches the bag around opening 104 closing the bag. In one embodiment, a toggle clip is provided on cord 106 to facilitate securing cord 106 relative to the bag when the bag is cinched around the opening.

Figure 9:
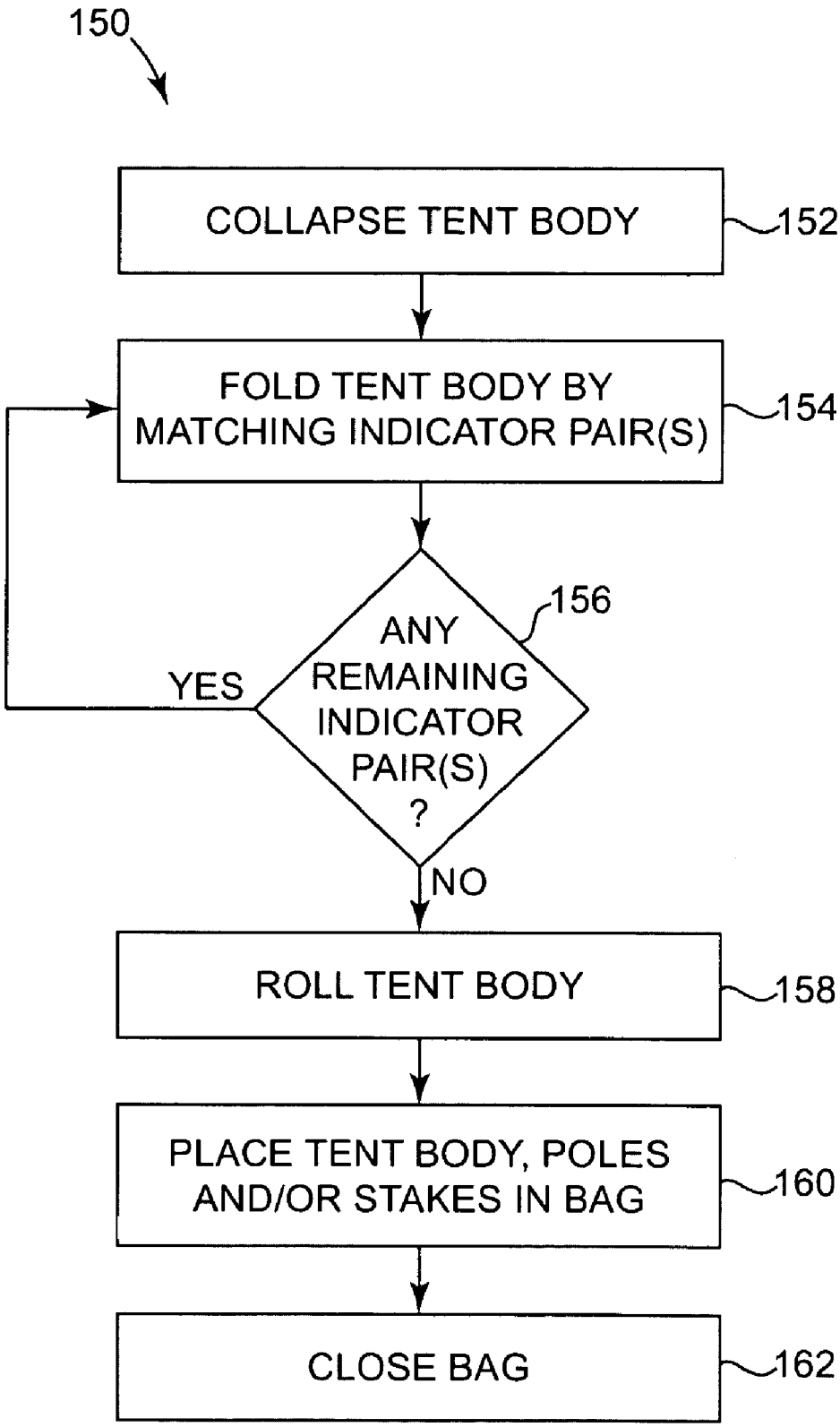
FIG. 9 is a flow chart of a method of preparing a tent body for storage and/or transportation, according to one embodiment of the present invention.

FIG. 9 illustrates one example of a method of preparing tent body 12 for storage and/or transport as generally indicated at 150. More specifically, once framework 14 (FIG. 1) and/or any stakes, etc. are removed from or otherwise uncoupled with tent body 12 as needed, tent body 12 is collapsed at 152. For example, side walls 30 are folded inward toward one another, and rear wall 28 is folded down at least partially over side walls 30 toward front edge 50. Finally, front wall 26 is folded down at least partially over rear wall 28 toward rear edge 52. As such, tent body 12 is positioned in a generally flat configuration.

At 154 and 156, the user folds tent body 12 as directed by visual inspection of fold indicators 60 and/or fold line markings 62. For example, when tent body 12 is in the initial collapsed position illustrated in FIG. 2, a plurality of fold line indicators is visible. However, user is instructed to first fold or otherwise bend tent body 12 to match the first fold indicator pair 70 and 72 by labeling 64, which marks each indicator pair 70 and 72 with a number "1" or other demarcation configured to intuitively instruct user where to begin folding tent body 12. Accordingly, at 154, the user folds tent body 12 matching first fold indicator 70 to second fold indicator 72 (e.g., placing first fold indicator 70 to lie directly over second fold indicator 72) such that tent body is folded along first fold line 76 (or first fold contour; FIG. 6). In one example, fold line marking 74 further indicates where tent body 12 should be folded and/or at least partially verifies that tent body 12 is being properly folded into the configuration illustrated in FIG. 6.

At 156, the user determines if additional fold indicators remain unmatched with other corresponding fold indicators. For example, as shown in FIG. 6, after folding tent body 12 along first fold line 76, a second indicator pair including third fold indicator 80 and fourth fold indicator 82 is visible, which indicates that an additional fold indicator pair remains. Accordingly, operation 154 is repeated by the user folding tent body 12 to match the second fold indicator pair by folding tent body 12 along second predetermined fold line 86. In one embodiment, folding tent body 12 along first and second fold lines 76 and 86 manipulates tent body 12, such that a portion of floor 20 and bottom portion 44 faces upward. In such an example, fabric enclosure 22 is folded to an interior of folded tent body 12 interposed between different sections of floor 20 and bottom portion 44.

Following folding tent body along second fold line 86, tent body 12 is in the configuration illustrated in FIG. 7. At 156, user again views tent body 12 to determine if additional fold indicators remain unmatched with other corresponding fold indicators. For example, as shown in FIG. 7, third fold indicator pair including fifth fold indicator 90 and sixth fold indicator 92 is visible and remains unmatched. Accordingly, at 154, user folds tent body 12 to match the third fold indicator pair by folding tent body 12 along third predetermined fold line 96 (FIG. 8).

Returning to operation 156, user again views tent body 12 to determine if additional fold indicators remain unmatched with other corresponding fold indicators. In one example, following folding tent body 12 along third predetermine fold line 96, no fold line indicator pairs remain unmatched. As such, by the lack of any additional visible fold line indicators, the user is intuitively instructed that all primary folds have been formed. When all primary folds have been formed, a width of the folded tent body 12 is slight smaller than a corresponding depth of a storage container 102 (FIG. 8). Then, at 158, the user rolls the now elongated relatively narrowly configured tent body 12 to form bundle 100 (FIG. 8). In one example, additional demarcations (not shown), etc. may be included on tent body 12 instructing the user to roll the tent as the next step. In one example, no demarcations indicate that tent body 12 should be rolled, but rather based on prior folding of tent body 12 or other tents, a user is expected to realize that that the final or near final step in preparing tent body 12 for storage is rolling tent body 12.

Figure 8:
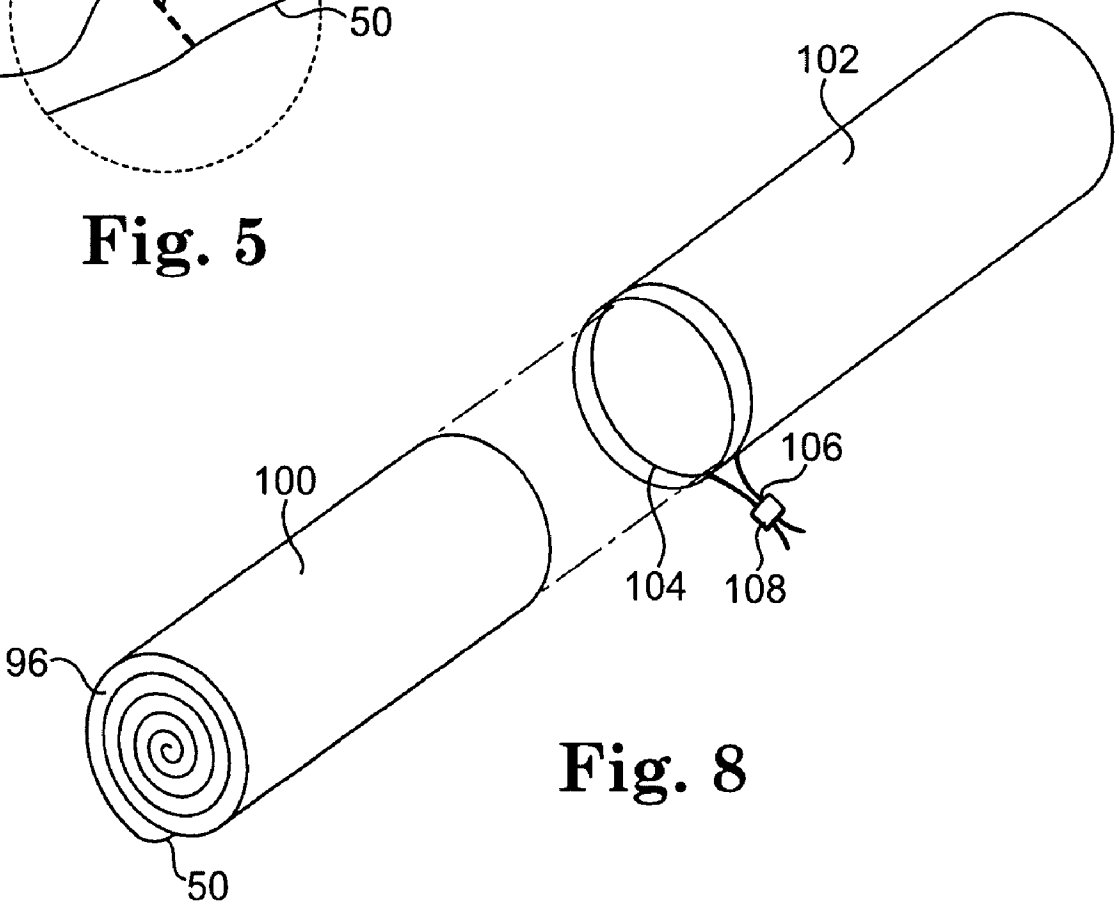
FIG. 8 is a perspective view of the tent body of FIG. 1 and a corresponding storage container, accordingly to one embodiment of the present invention.

Since tent body 12 was folded along predetermined fold lines 76, 86 and 96 before rolling, tent body 12 is more consistently able to be configured into bundle 100 in a manner having dimensions allowing bundle 100 to easily be slid into or otherwise placed into storage container 102 as generally indicated in FIG. 8. Accordingly, at 160, the user relatively easily slides or places bundle 100 into corresponding storage container 102 to collectively form a tent assembly. In one embodiment, given the more consistent size of bundle 100, at 160, the user may also place framework 14 (e.g., poles), any stakes, etc. into storage container 102 with bundle 100 if so desired. Finally, at 162, storage container 102 is closed, for instance by pulling toggle clip 108 tight along cords 106 to cinch storage container 102 around its opening 104.

In view of the above description, tents including fold line indicators and/or fold line markings provide a user with a tent body that can easily and repeatedly be folded and/or rolled into a desired configuration with desired dimensions to fit a corresponding storage container. Although the initial deconstruction and folding of the tent body may include a user referencing separate instructions, subsequent deconstruction and folding of the same tent body generally do not require use of an instruction manual due to the intuitive and self-instructing nature of the corresponding indicators and/or markings. Accordingly, user frustration is greatly diminished as tent body will likely easily fit within storage container following folding, etc. without requiring additional manipulation or force to fit the tent body to within the storage container. Such ease of deconstruction is particularly helpful when the user is under additional duress in preparing the tent for storage (e.g., during inclement weather, time constraints, etc.).

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. A tent assembly comprising a storage container;

a tent body configured to transition from an erect position to a collapsed position, wherein the tent body is configured to be folded along a plurality of predetermined fold lines to fit within the storage container when the tent body is in the collapsed position;

a first fold guide coupled to the tent body and spaced a first distance from and positioned on a first side of one of the plurality of predetermined fold lines;

a second fold guide coupled to the tent body and spaced the first distance from and positioned on a second side of the one of the plurality of predetermined fold lines, wherein the second side is opposite the first side relative to the one of the plurality of predetermined fold lines, wherein the first fold guide and the second fold guide collectively define a first pair of fold guides, the one of the plurality of predetermined fold lines is a first one of the plurality of predetermined fold lines;

a third fold guide coupled to the tent body and spaced a second distance from and positioned on a first side of a second one of the plurality of predetermined fold lines; and a fourth fold guide coupled to the tent body and spaced the second distance from and positioned on a second side of the second one of the plurality of predetermined fold lines;

wherein:

the third fold guide and the fourth fold guide collectively define a second pair of fold guides, the first pair of fold guides is positioned on a top portion of the tent body, the second pair of fold guides is positioned on a bottom portion of the tent body, and when the tent body is in the erect position, the top portion substantially extends upwardly from ground level while the bottom portion substantially extends along the ground level.

2. The tent assembly of claim 1, wherein the first fold guide and the second fold guide are visually identifiable as each being part of the first pair of fold guides.

3. The tent assembly of claim 1, wherein the first fold guide and the second fold guide are ones of a plurality of fold guides coupled to the tent body relating to the plurality of predetermined fold lines of the tent body, and the plurality of fold guides includes means for identifying an order in which the tent body should be folded along each of the plurality of predetermined fold lines.

4. The tent assembly of claim 1, wherein the first distance is equal to the second distance.

5. The tent assembly of claim 1, wherein when the tent body is folded along the first one of the plurality of predetermined fold lines, the third fold guide transitions from a hidden position to a visible position.

6. The tent assembly of claim 1, wherein a fold marking is coupled to the tent body and is positioned to at least partially coextend with the one of the plurality of predetermined fold lines.

7. The tent assembly of claim 1, wherein tent body includes a floor and a fabric enclosure extending upwardly from the floor, and the first fold guide and the second fold guide are each coupled to the floor.

8. The tent assembly of claim 7, wherein:

the floor includes a first section that forms at least part of the bottom portion of the tent body and a second section that forms part of the top portion of the tent body, and the first fold guide and the second fold guide are each coupled to the second section of the floor.

9. The tent assembly of claim 1, wherein the first fold guide and the second fold guide are each coupled to the tent body by one or more of printing, sewing, ultrasonic welding, and adhering.

10. The tent assembly of claim 1, wherein when the tent body is folded along each of the plurality of predetermined fold lines, the tent body has a final width slightly smaller than at least one inside dimension of the storage container.

11. A tent assembly comprising a storage container;

a tent body configured to transition from an erect position to a collapsed position, wherein the tent body is configured to be folded along a plurality of predetermined fold lines to fit within the storage container when the tent body is in the collapsed position;

a first fold guide coupled to the tent body and spaced a first distance from and positioned on a first side of one of the plurality of predetermined fold lines;

a second fold guide coupled to the tent body and spaced the first distance from and positioned on a second side of the one of the plurality of predetermined fold lines, wherein the second side is opposite the first side relative to the one of the plurality of predetermined fold lines, wherein the first fold guide and the second fold guide collectively define a first pair of fold guides;

a third fold guide coupled to the tent body and spaced a second distance from and positioned on the first side of the one of the plurality of predetermined fold lines; and a fourth fold guide coupled to the tent body and spaced the second distance from and positioned on the second side of the one of the plurality of predetermined fold lines;

wherein the third fold guide and the fourth fold guide collectively define a second pair of fold guides, the first pair of fold guides is positioned near a first edge of the tent body, the second pair of fold guides is positioned near a second edge of the tent body that is opposite the first edge of the tent body, and the one of the plurality of predetermined fold lines extends between the first edge and the second edge of the tent body.

12. The tent assembly of claim 11, wherein the first distance is substantially equal to the second distance.

13. The tent assembly of claim 11 wherein the first fold guide, the second fold guide, the third fold guide, and the fourth fold guide are ones of a plurality of fold guides coupled to the tent body relating to the plurality of predetermined fold lines of the tent body, and the plurality of fold guides includes means for identifying an order in which the tent body should be folded along each of the plurality of predetermined fold lines.

14. The tent assembly of claim 11 further comprising:

a fifth fold guide coupled to the tent body and spaced a second distance from and positioned on a first side of a second one of the plurality of predetermined fold lines; and a sixth fold guide coupled to the tent body and spaced the second distance from and positioned on a second side of the second one of the plurality of predetermined fold lines;

wherein:

the fifth fold guide and the sixth fold guide collectively define a third pair of fold guides, the first pair of fold guides is positioned on a top portion of the tent body, the third pair of fold guides is positioned on a bottom portion of the tent body, when the tent body is in the erect position, the top portion substantially extends upwardly from ground level while the bottom portion substantially extends along the ground level, and when the tent body is folded along the first one of the plurality of predetermined fold lines, the fifth fold guide transitions from a hidden position to a visible position.

15. The tent assembly of claim 11, wherein a fold marking is coupled to the tent body and is positioned to at least partially coextend with the one of the plurality of predetermined fold lines.

16. The tent assembly of claim 11, wherein the tent body includes a floor and a fabric enclosure extending upwardly from the floor, and the first fold guide and the second fold guide are each coupled to the floor.

17. The tent assembly of claim 16, wherein:

the floor includes a first portion that extends parallel to a ground when the tent is in the erect position and a second portion that extends upwardly from the first portion away from the ground when the tent is in the erect position, and the first fold guide and the second fold guide are each coupled to the second portion of the floor.

18. A method of providing a tent configured to substantially self-instruct a user regarding how to manipulate the tent for storage of the tent, the method comprising:

providing a tent body defining a shelter when erected for use and configured to collapse to a relatively flat state during periods of non-use;

affixing a plurality of indicator pairs to the tent body, each indicator pair indicating where a corresponding desired line in a series of desired lines should be formed in the tent body when the tent body is bent over itself, wherein:

the series of desired lines are positioned such that, when the tent body is bent along each of the series of desired lines, the tent body is manipulated to create a compact tent body having at least one dimension that is smaller than a corresponding dimension of a storage container specifically associated with the tent body, the plurality of indicator pairs indicate a desired sequence for bending the tent body along each of the series of desired lines, and the plurality of indicator pairs includes a first indicator pair;

affixing a supplemental indicator pair to the tent body, wherein the first indicator pair and the supplemental indicator pair collectively indicate where a first line in the series of desired lines will be formed in the tent body when the tent body is bent over itself to match the first indicator pair to the supplemental indicator pair, wherein:

when collapsed the tent body defines a first outermost edge and a second outermost edge opposite the first outer edge, the first line extends from the first outermost edge to the second outermost edge, the first indicator pair is affixed to the tent body along the first outermost edge, and the second indicator pair is affixed to the tent body along the second outermost edge.

19. The method of claim 18, wherein each of the plurality of indicator pairs is numbered or lettered in a well-known sequence.

20. The method of claim 18, wherein affixing a plurality of indicator pairs to the tent body includes affixing a first portion of the plurality of indicator pairs to a top of the tent body and affixing a second portion of the plurality of indicator pairs to a bottom of the tent body as defined when the tent body is in the relatively flat state.

21. The method of claim 18, wherein each indicator included in an individual one of the plurality of indicator pairs is located on an opposite side of a corresponding one of the series of desired lines as compared to another indicator included in the individual one of the plurality of indicator pairs.

* * * * *